United States Patent [19]

Sherwin

[11] 4,141,554

[45] Feb. 27, 1979

[54] ARROW SHAFT SOCKET

[76] Inventor: Donald D. Sherwin, 701 Madison St., Port Richey, Fla. 33568

[21] Appl. No.: 765,156

[22] Filed: Feb. 3, 1977

[51] Int. Cl.[2] ..... F41B 5/02

[52] U.S. Cl. ..... 273/106.5 R; 273/106.5 B; 273/106.5 C; 403/268; 403/292

[58] Field of Search ..... 273/106.5 B, 106.5 R, 273/106.5 C; 403/268, 265, 292

[56] References Cited

U.S. PATENT DOCUMENTS

| | | | |
|---|---|---|---|
| 569,235 | 10/1896 | Rockwell | 403/265 |
| 653,328 | 7/1900 | Tyden | 403/292 |
| 752,669 | 2/1904 | Guzowski | 403/268 |
| 2,702,926 | 3/1955 | Rahaim | 403/265 X |
| 2,994,353 | 8/1961 | Yearley | 403/268 X |
| 3,334,901 | 8/1967 | Steffes | 403/265 X |
| 3,868,114 | 2/1975 | Groner | 273/106.5 B |
| 3,915,455 | 10/1975 | Savora | 273/106.5 B |

OTHER PUBLICATIONS

Archery Magazine, Oct. 1972, p. 29, Robin Hood Change-A-Points.

Archery Magazine, Jun. 1976, p. 9, "R.P.S.," System.

*Primary Examiner*—Paul E. Shapiro

*Attorney, Agent, or Firm*—Stanley M. Miller

[57] ABSTRACT

An arrow shaft socket is disclosed which solves the problem of inserting a hollow threaded socket into a cavity in an arrow shaft without forcing adhesive within the cavity to flow onto the threaded portion. This problem is solved by forming a substantially hemispherical radius on the front of the insert end and providing a small air hole in the insert end. An alternate embodiment can include the provision of one or more axial grooves along the outside of the insert to permit excess adhesive to flow out of the cavity.

15 Claims, 6 Drawing Figures

ARROW SHAFT SOCKET

BACKGROUND OF THE INVENTION

Target and field archery have become popular sports and the increased public demand for archery equipment has provided an impetus for the application of mass production techniques to the manufacture of arrows.

Arrow tips and feather assemblies have been attached to the arrow shaft by a variety of mechanisms in the prior art. U.S. Pat. No. 3,910,579 to Sprandel discloses an arrow head mounting socket within which the arrow head shaft is mounted with a portion protruding through a hole in the inward facing flat end of an end insert and clamped by a gripping washer. U.S. Pat. No. 3,915,455 to Savora discloses an insert having a flat, closed, inward facing end in which the arrow head shaft is screw mounted. U.S. Pat. No. 3,868,114 to Groner discloses an arrow head insert having circumferential grooves on the outside of the insert and a threaded hole going all the way through the end of the insert. To make these prior art structures amenable to mass production, they typically employ a mechanically swagged anchorage of the mounting socket to the arrow shaft. The use of a simpler and less expensive glueing operation for attaching shaft sockets has been avoided in the prior art for mass produced arrows because the adhesive tends to foul the tip mounting threads in the socket and air entrapped in the adhesive coated hole in the end of the shaft tends to force the socket away from its seated position before having time to set.

OBJECTS OF THE INVENTION

It is therefore an object of the invention to provide an improved arrow shaft socket for mass produced arrows.

It is another object of the invention to provide an improved arrow shaft socket which can be more easily inserted into an adhesive coated hole in the end of the shaft without being displaced by entrapped air.

It is yet another object of the invention to provide an improved arrow shaft socket which can be inserted into an adhesive coated hole in the end of the shaft without fouling the tip mounting threads within the socket.

SUMMARY OF THE INVENTION

These and other objects, features and advantages are provided by the improved arrow shaft socket disclosed herein.

An improved arrow shaft socket is disclosed for screw mounting an end portion such as an arrow tip, a stabilizing feather assembly, or an arrow shaft extension onto the arrow shaft, wherein the socket may be more easily inserted into an adhesive coated axial hole in one end of the arrow shaft by allowing entrapped air to pass through a small hole in the socket while a hemispherically contoured front surface of the socket plows through the adhesive. The socket comprises a substantially cylindrical, hollow tube with an open end and a substantially closed end, having an inner cylindrical threaded surface of an inner radius and an outer cylindrical surface of an outer radius. The closed end of the tube has a small, substantially circular hole therethrough, substantially coaxial with the inner cylindrical surface, having a radius substantially smaller than the inner radius of the threaded surface. The closed end of the tube has an external surface substantially hemispherical in shape, with a radius substantially the same as the external radius of the outer surface. Upon inserting the closed end of the tube into an adhesive coated cavity in the end of the arrow shaft, entrapped air will be admitted through the small hole and the hemispherical contoured surface will plow through the adhesive, thereby preventing the adhesive from flowing onto the threaded surface, thereby fouling the threads.

DESCRIPTION OF THE FIGURES

The various features of the improved arrow shaft socket will be more fully appreciated by referring to the figures.

DISCUSSION OF THE PREFERRED EMBODIMENT

Figure 1:
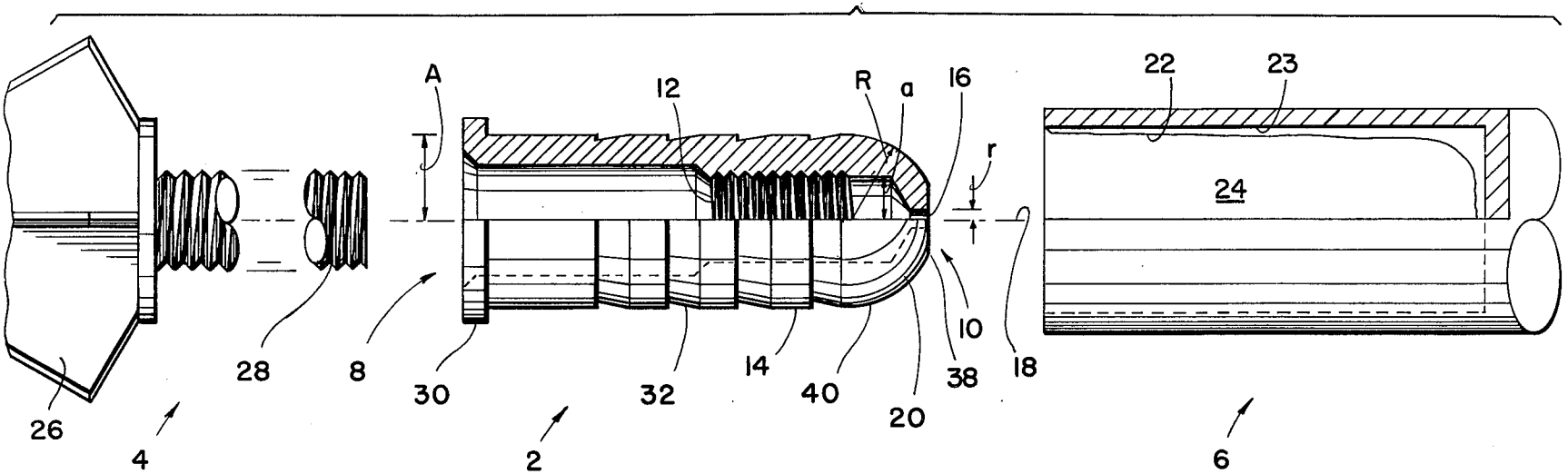
FIG. 1 is an exploded view of the relative positions of the arrow shaft socket 2, the arrow end portion 4, and the arrow shaft 6, with the arrow shaft socket 2 and arrow shaft 6 shown in partial cross section.
Figure 3:
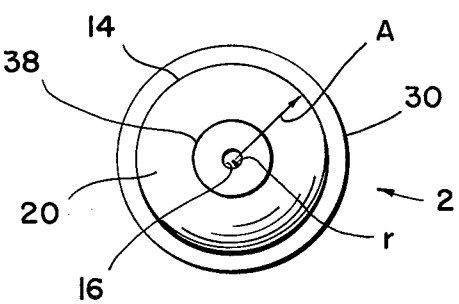
FIG. 3 is an end view in the opposite direction from that of FIG. 2, of the closed end 10 of the arrow shaft socket 2.
Figure 2:
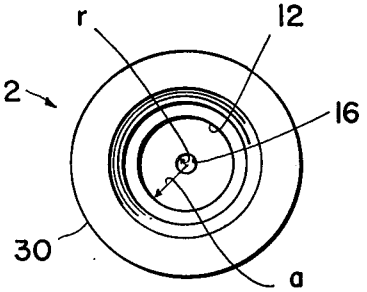
FIG. 2 is an end view of the open end 8 of the arrow shaft socket 2.

FIG. 1 shows an exploded view of the relative positions of the arrow shaft socket 2, the arrow end portion 4, and the arrow shaft 6. The arrow shaft socket 2 is a substantially cylindrical, hollow tube with an open end 8 shown to better advantage in FIG. 2 and a substantially closed end 10 shown to better advantage in FIG. 3. The socket 2 has an inner cylindrical threaded surface 12 of an inner radius a and an outer cylindrical surface 14 of an outer radius A. The closed end 10 of the tube 2 has a small, substantially circular hole 16 therethrough, which is substantially coaxial with the cylinder axis 18 and with the inner cylindrical surface 12. The circular hole 16 has a radius r substantially smaller than the inner radius a of the inner cylindrical surface 12. The closed end 10 of the tube 2 has an external surface 20 which is substantially hemispherical in shape with a radius R which is substantially the same as the external radius A of the surface 14.

The arrow shaft 6 has a cylindrical hole 24 in one end thereof into which the external surface 14 of the arrow shaft socket 2 is seated in the final assembly. The inner surface of the hole 24 for the arrow shaft 6 is coated with an adhesive 22 which bonds the arrow shaft socket 2 to the arrow shaft 6. The hemispherical contour 20 of the closed end 10 of the arrow shaft socket 2 facilitates the insertion of the socket 2 into the hole 24 of the arrow shaft 6 by effectively plowing through the viscus adhesive coating 22 therein. The small, substantially circular hole 16 in the closed end 10 of the arrow shaft socket 2 allows air entrapped in the hole 24 during the insertion of the arrow shaft socket 2, to pass therethrough while minimizing the quantity of the viscus adhesive coating 22 which might flow therethrough. This prevents air which might otherwise be compressed within the hole 24, from forcing the insert 2 out of the hole 24 before the adhesive 22 can harden.

A suitable composition for the adhesive 22 is liquid epoxy resin which may be a stoichiometric mixture of epichlorohydrin and diglycidyl either of bisphenol-A.

The resin may be homopolymerized with a tertiary amine or Lewis acid or copolymerized with primary or secondary aliphatic amines. The reaction with primary and secondary amines is exothermic and the cure may be carried out at room temperature. The resulting cured adhesive has a low shrinkage and an absence of volitile reactants. The cured epoxy has a lap shear adhesive strength which may exceed 4,000 psi and forms a good bond between the arrow shaft socket 2 and the arrow shaft 6. The uncured, liquid epoxy resin has a viscosity of approximately 5,000 centipoises at 30° C., the approximate temperature at which the assembly of the arrow shaft socket 2 to the arrow shaft 6 takes place. It has been found that the following arrow shaft socket dimensions are most suitable for an uncured adhesive having approximately this viscosity, to enable the tube to be more easily inserted into the adhesive coated axial hole 24 so as to enable entrapped air to pass through the small hole 16 without the adhesive 22 flowing onto the threaded surface 12. For an arrow shaft having an approximate external diameter of ⅜ inch, the inside diameter of the hole 24 in the arrow shaft 6 can be 11/32 inch. The outer radius A of the outer cylindrical surface 14 can be 5/32 inch. The hemispherical surface 20 will then have a radius of approximately 5/32 inch which is the optimum contour to enable the closed end 10 of the arrow shaft socket 2 to plow through the adhesive coating 22 within the hole 24. If the inner cylindrical surface 12 has a radius a of 0.0747 inch formed by a number 25 drill and is tapped with an 8–32 thread, the optimum value of the radius r for the hole 16 is 0.0260 in. formed by number 55 drill, so as to allow entrapped air to pass through the hole 16 without the adhesive 22 of this viscosity flowing onto the threaded surface 12.

As is seen from FIG. 1, the adhesive 22 is coated around the inner circumferential surface 23 of the cylindrical hole 24 in the arrow shaft 6. As the closed end 10 of the arrow shaft socket 2 is inserted into the hole 24, the portions 38 of the hemispherical surface 20 which are closest to the central axis 18, serve to brush back or guide accumulations of the adhesive 22 to portions 40 of the hemispherical surface 20 which are farther from the central axis 18, so that the adhesive 22 flows back over the outer cylindrical surface 14 which has a diameter approximately 0.002 inch less than the inner diameter of the cylindrical hole 24 in the arrow shaft 6. A hemispherical contour to the surface 20 functions much better than a simple conical chamfer since the sloping angle of the inner edge 38 of the hemispherical contour for the surface 20 can be brought closer to the central axis 18 so as to guide adhesive which may have accumulated in that region, in a direction away from the central axis, while at the same time maximizing the peripheral bonding area for the outer cylindrical surface 14 by the addition of the convex portion 40 of the surface 20, to enhance the bonding strength between the arrow shaft insert and the arrow shaft 6. Since the distance between the inner edge 38 of the hemispherical surface 20 and the central axis 18 is to be minimized, and yet since there must be an air hole 16 to allow entrapped air to escape to facilitate the retention of the insert 2 within the hole 24 while the adhesive 22 is hardening, the radius r of the hole 16 has to be correspondingly small. With the above recited dimensions for the arrow shaft insert, the radial distance between the central axis 18 and the inner edge 33 of the hemispherical surface 20 should be approximately 0.0625 inch. Thus, the radius r of the hole 16 should be approximately 0.0260 inch which is drilled by a number 55 drill. The small size of the hole 16 has the additional advantage of reducing the probability that liquid adhesive 22 will flow therethrough. The relatively larger radius a which equals 0.0747 inch for the inner cylindrical threaded surface 12, increases the distance between the hole 16 and the threaded surface 12, thereby further reducing the probability that any adhesive 22 which may have flowed through the hole 16, will in fact, come into contact with the threaded surface 12, thereby fouling the threads. Thus, it is seen that there is a tight interrelationship between the hemispherical contour for the surface 20 which facilitates the plowing through and flowing back of the adhesive 22 onto the outer cylindrical surface 14, and the size of the entrapped air escape hole 16 whose small size enables the inner edge 38 of the hemispherical contour 20 to come close to the central axis 18 and whose small size also minimizes the probability of passage of adhesive therethrough and the further migration of adhesive to the threaded surface 12 which has a radius larger than the radius r of the hole 16. This combination makes the arrow shaft insert assembly more amenable to mass production since the socket may be more easily inserted into an adhesive coated axial hole in the arrow shaft and will remain seated in that hole after having been automatically positioned therein, without being pushed out by entrapped air, while at the same time preventing the adhesive from flowing onto the threaded surface 12, thereby fouling the threads.

Figure 4:
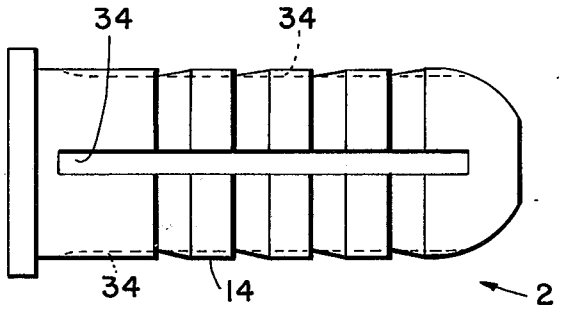
FIG. 4 depicts an alternate embodiment for the arrow shaft socket 2.

FIG. 4 illustrates an alternate embodiment of the arrow shaft socket 2 wherein additional axial grooves 34 are formed in the surface 14 to permit excess adhesive 22 to flow from within the hole 24 in the end of the arrow shaft 6 when the arrow shaft socket 2 is inserted therein.

Figure 5:
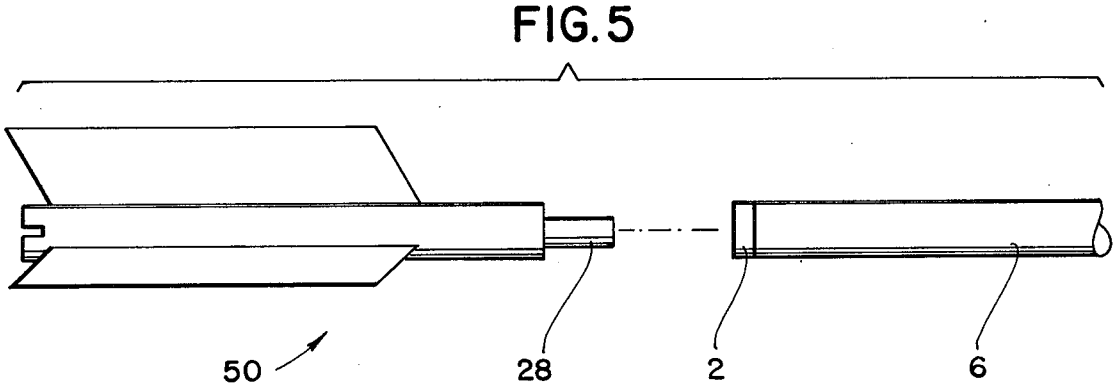
FIG. 5 shows the stabilization feather assembly 50 as the end portion 4.
Figure 6:
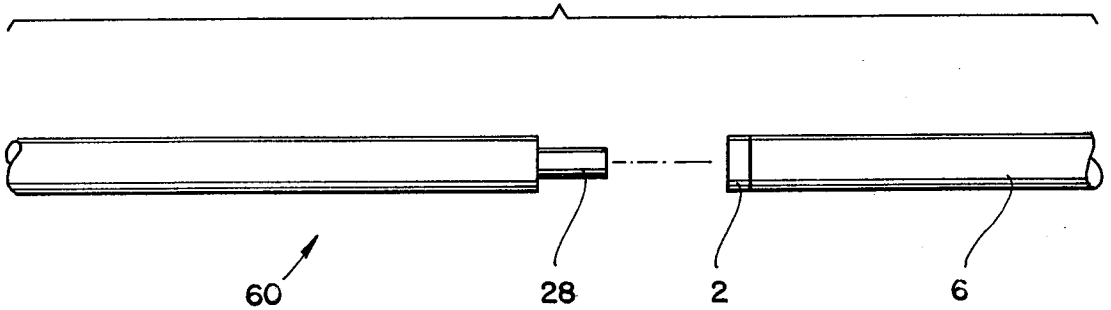
FIG. 6 shows the arrow shaft extension 60 as the end portion 4.

FIG. 1 illustrates the end portion 4 as an arrow tip 26 having a threaded portion 28 which threadably engages the inner threaded surface 12 of the arrow shaft socket 2. The end portion 4 may also be a stabilization feather assembly 50, as shown in FIG. 5, which would substitute for the arrow tip 26. The end portion 4 may also be an arrow shaft extension 60, as shown in FIG. 6, which would substitute for the arrow tip 26.

The open end 8 of the arrow shaft socket 2 has an external flange 30 thereon, which seats the arrow shaft socket 2 within the hole 24 in the end of the arrow shaft 6, and reinforces the shaft to take shock upon impact rather than the shaft.

In FIG. 1, it is seen that the outer cylindrical surface 14 of the arrow shaft socket 2 has a plurality of circumferential grooves 32 therein for anchoring the arrow shaft socket 2 into the hole 24 in the end of the arrow shaft 6.

The resulting arrow shaft socket solves the problem of inserting a hollow threaded socket into the cavity in an arrow shaft without forcing adhesive in the cavity to flow onto the threaded portion. This problem is solved by forming a substantially hemispherical radius on the front of the insert end and providing a small air hole in the insert end. Upon inserting the closed end of the tube into the adhesive coated cavity in the end of the arrow shaft, entrapped air will be admitted through the small hole and the hemispherical contoured surface will plow through the adhesive, thereby preventing the adhesive from flowing onto the threaded surface, thereby fouling the thread. This improvement to the arrow shaft socket makes the structure amenable to mass production techniques.

It should be understood other modifications within the spirit of the invention will occur to those skilled in the art when viewing the foregoing disclosure and that the purpose of the foregoing description is intended to be illustrative and not limiting, the scope of the invention being set forth in the appended claims.

I claim:

1. An improved arrow shaft socket for mounting an end portion of the arrow thereto, comprising:

a substantially cylindrical, hollow tube with an open end and a substantially closed end, having an inner, cylindrical, threaded surface of an inner radius and an outer, cylindrical surface of an outer radius;

said closed end of said tube having a small, substantially circular hole therethrough, substantially coaxial with said inner cylindrical surface, having a radius substantially smaller than said inner radius;

said closed end of said tube having an external surface substantially hemispherical in shape, with a radius substantially the same as said external radius;

whereby said tube may be more easily inserted into an adhesive coated, axial hole in one end of an arrow shaft, allowing entrapped air to pass through said small hole without the adhesive flowing onto said threaded surface.

2. The apparatus of claim 1, wherein said open end of said tube has an external flange thereon, for seating said tube in said hole in the end of the arrow shaft.

3. The apparatus of claim 1, wherein said outer, cylindrical surface of said tube has a plurality of circumferential grooves therein for anchoring said tube in said hole in the end of the arrow shaft.

4. The apparatus of claim 3, wherein said outer, cylindrical surface of said tube has an axial groove therein to permit excess adhesive to flow from said hole in the end of the arrow shaft when said tube is inserted therein.

5. The apparatus of claim 4, wherein there are a plurality of said axial grooves in said outer, cylindrical surface.

6. The apparatus of claim 1, wherein said outer, cylindrical surface of said tube has an axial groove therein to permit excess adhesive to flow from said hole in the end of the arrow shaft when said tube is inserted therein.

7. The apparatus of claim 6, wherein there are a plurality of said axial grooves in said outer, cylindrical surface.

8. In combination, an improved arrow shaft socket for mounting an end portion of the arrow to an arrow shaft, comprising:

a substantially cylindrical, hollow tube with an open end and a substantially closed end, having an inner, cylindrical, threaded surface of an inner radius and an outer, cylindrical surface of an outer radius;

an end portion which threadably engages said inner surface of said tube;

said closed end of said tube having a small, substantially circular hole therethrough, substantially coaxial with said inner cylindrical surface, having a radius substantially smaller than said inner radius;

said closed end of said tube having an external surface substantially hemispherical in shape, with a radius substantially the same as said external radius;

whereby said tube may be more readily inserted into an adhesive coated, axial hole in one end of an arrow shaft, allowing entrapped air to pass through said small hole without the adhesive flowing onto said threaded surface.

9. The combination of claim 8, wherein said end portion is an arrow tip.

10. The combination of claim 8, wherein said end portion is a stabilizing feather assembly.

11. The combination of claim 8, wherein said end portion is an arrow shaft extension.

12. In combination, an improved arrow shaft socket for mounting an end portion of the arrow to an arrow shaft, comprising:

a substantially cylindrical, hollow tube with an open end and a substantially closed end, having an inner, cylindrical, threaded surface of an inner radius and an outer, cylindrical surface of an outer radius;

an end portion which threadably engages said inner surface of said tube;

said closed end of said tube having a small, substantially circular hole therethrough, substantially coaxial with said inner cylindrical surface, having a radius substantially smaller than said inner radius;

said closed end of said tube having an external surface substantially hemispherical in shape, with a radius substantially the same as said external radius;

an arrow shaft having an adhesive coated axial hole in one end thereof into which said outer surface of said tube is mounted;

whereby said tube may be more easily inserted into said adhesive coated, axial hole in one end of said arrow shaft, allowing entrapped air to pass through said small hole without the adhesive flowing onto said threaded surface.

13. The combination of claim 12, wherein said end portion is an arrow tip.

14. The combination of claim 12, wherein said end portion is a stabilizing feather assembly.

15. The combination of claim 12, wherein said end portion is an arrow shaft extension.

* * * * *